US007021008B2

(12) United States Patent
Busby et al.

(10) Patent No.: US 7,021,008 B2
(45) Date of Patent: Apr. 4, 2006

(54) INFLATABLE STRUCTURE WITH INFLATABLE INTERIOR FRAME

(76) Inventors: Tyler E. Busby, 104 Bennington Hills Ct., West Henrietta, NY (US) 14586; Chris Wilson, 2737 Forrest Hill Dr., Corning, NY (US) 14830

( * ) Notice: Subject to any disclaimer, the term of this patent is extended or adjusted under 35 U.S.C. 154(b) by 48 days.

(21) Appl. No.: 10/339,626

(22) Filed: Jan. 10, 2003

(65) Prior Publication Data

US 2004/0134133 A1 Jul. 15, 2004

(51) Int. Cl.
*E04B 1/34* (2006.01)

(52) U.S. Cl. ..... 52/2.11; 5/689

(58) Field of Classification Search ..... 52/2.11, 52/2.18, 2.19, 2.22, 2.23, 2.24; 5/689, 706, 5/707, 710, 714

See application file for complete search history.

(56) References Cited

U.S. PATENT DOCUMENTS

| | | | | | |
|---|---|---|---|---|---|
| 3,710,791 | A * | 1/1973 | Deaton | 128/205.26 |
| 4,114,325 | A | 9/1978 | Hochstein | 52/2 |
| 4,332,112 | A * | 6/1982 | Hsu | 52/2.21 |
| 4,766,918 | A * | 8/1988 | Odekirk | 52/2.23 |
| 4,802,734 | A | 2/1989 | Walter | 350/117 |
| 5,007,212 | A * | 4/1991 | Fritts et al. | 52/2.18 |
| 5,115,998 | A | 5/1992 | Olive | 244/31 |
| 5,487,400 | A * | 1/1996 | Dawkins | 135/87 |
| 5,546,707 | A | 8/1996 | Caruso | 52/213 |
| 5,598,593 | A * | 2/1997 | Wolfe | 5/710 |
| 5,630,296 | A * | 5/1997 | Kendall, Jr. | 52/2.11 |
| 5,636,478 | A * | 6/1997 | Chen | 52/2.11 |
| 5,772,535 | A * | 6/1998 | Murphy | 473/415 |
| 6,061,969 | A * | 5/2000 | Leary | 52/2.11 |
| 6,076,214 | A | 6/2000 | Klimenko | 5/710 |
| 6,131,219 | A * | 10/2000 | Roberts | 5/644 |
| 6,775,868 | B1 * | 8/2004 | Mileti et al. | 5/710 |
| 2002/0023390 | A1 | 2/2002 | Nagle | 52/2.18 |

* cited by examiner

*Primary Examiner*—A. Joseph Wujciak, III

(57) ABSTRACT

An inflatable device with an outer inflatable structure, inflatable interior frame, an interior opening and an outer opening. The frame has a plurality of side rods, a center wall, a plurality of interconnected ribs and a plurality of air passages. The interior opening is on a rib and receives any common air pump. The interior frame becomes rigid upon inflation and, forces apart the walls of the outer inflatable structure. Once the interior frame is completely inflated, it provides support to the outer inflatable structure so that the main air chamber inside of the outer inflatable structure does not need to be fully inflated with air. A cap placed over the outer opening is fitted with an air pump valve in order that additional air may be pumped into the main air chamber to increase the firmness of the inflatable device.

4 Claims, 3 Drawing Sheets

INFLATABLE STRUCTURE WITH INFLATABLE INTERIOR FRAME

BACKGROUND OF THE INVENTION

1. Field of the Invention

The present invention relates to inflatable devices and, more particularly, to inflatable devices with a plurality of air chambers supported by an interior rigid, inflatable frame.

2. Description of the Related Art

Inflatable devices are commonly used for a number of different purposes. Inflatable devices are used as mattresses, floatation devices, pool rafts, water toys, temporary shelters and emergency devices. The majority of common inflatable devices must be manually inflated with either a hand pump or a motorized air pump. Because of the size of most inflatable devices it often requires a great deal of effort and time to inflate the device to the desired degree of firmness. Most common inflatable devices require filling the entire interior compartment of the device with air. In some situations it is not actually necessary to fill these entire compartments with air in order to achieve the appropriate degree of firmness. Some existing inflatable devices incorporate inflatable frameworks instead of inflating the entire structure of the device.

Specific examples of inflatable framework structures that are representative of the inflatable device industry are disclosed in the following United States patent documents. U.S. Pat. No. 4,802,734 to Walter discloses a cold air inflatable screen with side, back, top and bottom walls. The inflatable structure supports a white screen and houses a projector for displaying images on the front screen.

U.S. Pat. App. No. 2002/0023390 to Nagle discloses a temporary, inflatable work shelter. The inflatable work shelter comprises an inflatable framework with a cover material that is supported by the inflatable framework.

U.S. Pat. No. 5,546,707 to Caruso discloses an inflatable tube system. The tube includes a bladder, made of an elastometer in the shape of a cylinder, and a fabric covering made of woven polyethylene. An air valve extends into the bladder through an end closure. The inflatable tube system may be used in many applications and preferred embodiments of the invention are used in sporting equipment.

U.S. Pat. No. 4,114,325 to Hochstein discloses an inflatable structure for providing emergency accommodations. The structure is comprised of an inflatable framework with inflatable cushions disposed in the gaps of the framework.

U.S. Pat. No. 6,076,214 to Kilmenko discloses an inflatable mattress assembly. The assembly includes separate upper and lower compartments sealed together. By incorporating inflatable frames around the central sections of each component, the components may be sealed together at locations other than their outer edges.

None of the inflatable devices discussed above, or otherwise in existence, provide an inflatable device that can be inflated with little effort in little time. Therefore, what is needed is an inflatable device with an inflatable, interior framework that provides the appropriate degree of firmness without having to inflate the entire interior of the device. What is further needed is inflatable device with an inflatable, interior framework that requires less effort to inflate than the common inflatable device. What is still further needed is an inflatable device with an inflatable, interior framework that provides a means for inflating the device in less time than the common inflatable device. Finally, what is needed is an inflatable device with an inflatable, interior framework that may be inflated using smaller capacity air pumps.

None of the above inventions and patents, taken either singly or in combination, is seen to describe the instant invention as claimed. Thus an inflatable structure with inflatable interior frame solving the aforementioned problems is desired.

SUMMARY OF THE INVENTION

The invention is an inflatable device made of an outer inflatable structure with an inflatable, interior frame. The inflatable device comprises an outer inflatable structure, an inflatable interior frame, an internal opening and an outer opening. A main air chamber is located inside of the outer inflatable structure. The inflatable interior frame is also located inside of the outer inflatable surface and when inflated, the interior frame supports the walls of the outer inflatable structure. The internal opening is located on the inflatable interior frame and extends through the outer inflatable structure. The internal opening is adapted to receive an air pump for supplying air to inflate the interior frame. The outer opening is located on the outer inflatable structure. The outer opening provides a means for air to naturally enter the main air chamber.

In accordance with one aspect of the present invention air is pumped into the interior frame through the interior opening. As the interior frame is inflated it becomes rigid. The walls of the outer structure become forced apart because the main air chamber inside of the outer structure is filled with air that is naturally drawn through the outer opening. Once the interior frame is inflated and rigid, it supports the outer structure. Because the outer structure is supported by the interior frame, there is no need to fill the entire outer structure with air. The outer opening remains open as the interior frame is inflated allowing air to enter the main chamber. Once the interior frame is inflated enough to provide the desired degree of rigidity in the outer structure the outer opening is closed trapping the naturally drawn air in the main air chamber. A cap is placed over the outer opening. Additional air may be pumped into the main air chamber to increase the pressure inside.

Accordingly, it is a principal object of the invention to provide an inflatable device that can be inflated with little effort and in little time.

It is another object of the invention to provide an inflatable device with an inflatable, interior framework that provides the appropriate degree of rigidity without having to inflate the entire interior of the device.

It is a further object of the invention to provide an inflatable device with an inflatable, interior framework that requires less effort to inflate than the common inflatable device.

Still another object of the invention is to provide an inflatable device with an inflatable, interior framework that provides a means for inflating the device in less time than the common inflatable device.

Still another object of the invention is to provide an inflatable device with an inflatable, interior framework that may be inflated using smaller capacity air pumps.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
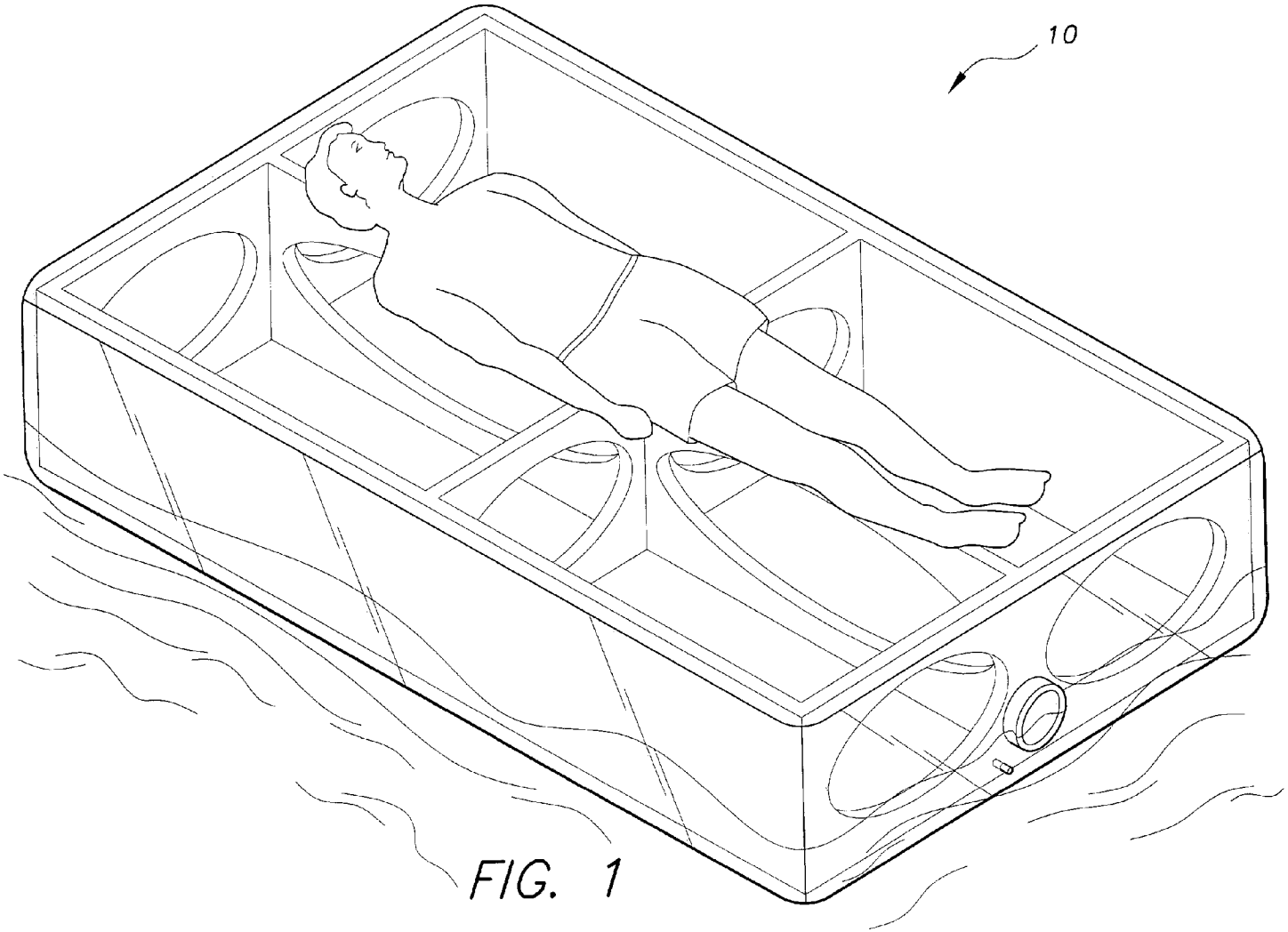
FIG. 1 is an environmental, perspective view of an inflatable structure with an inflatable interior frame according to the present invention.
Figure 2:
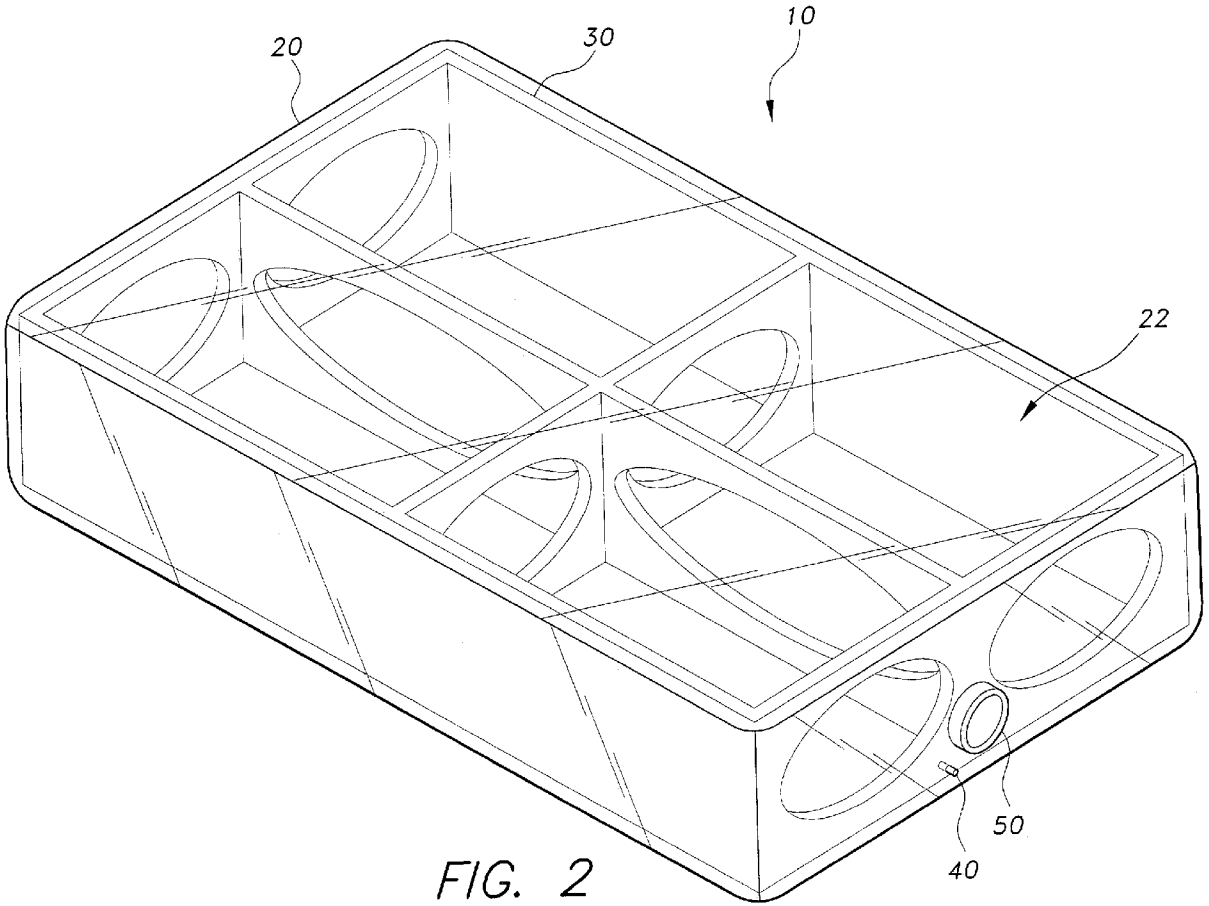
FIG. 2 is a perspective view of an inflatable interior frame inside of an outer inflatable structure.

The present invention is an inflatable device with an outer inflatable structure and inflatable interior frame. FIG. 1 is an environmental view of the present inflatable device 10 being used in a water raft. The inflatable device 10 is not limited to being used in water rafts and may be used in any application suitable for inflatable devices including, but not limited to mattresses, floatation devices, water toys, temporary shelters and emergency devices. FIG. 2 is a perspective view depicting the inflatable device 10. The inflatable device 10 comprises an outer inflatable structure 20, an inflatable interior frame 30, an interior opening 40 and outer opening 50.

The outer inflatable structure 20 further comprises a main air chamber 22 located inside of the walls of the outer inflatable structure 20. The inflatable interior frame 30 is located inside of the outer inflatable structure 20 in the main air chamber 22. The outer opening 50 is located on the exterior of the outer inflatable structure 20. The outer opening 50 is a large hole in the inflatable device 10 that allows for air to be naturally drawn into the main air chamber 22. The outer opening 50 must be large enough to allow a substantial amount of naturally drawn air to be drawn into the main air chamber 22.

Figure 3:
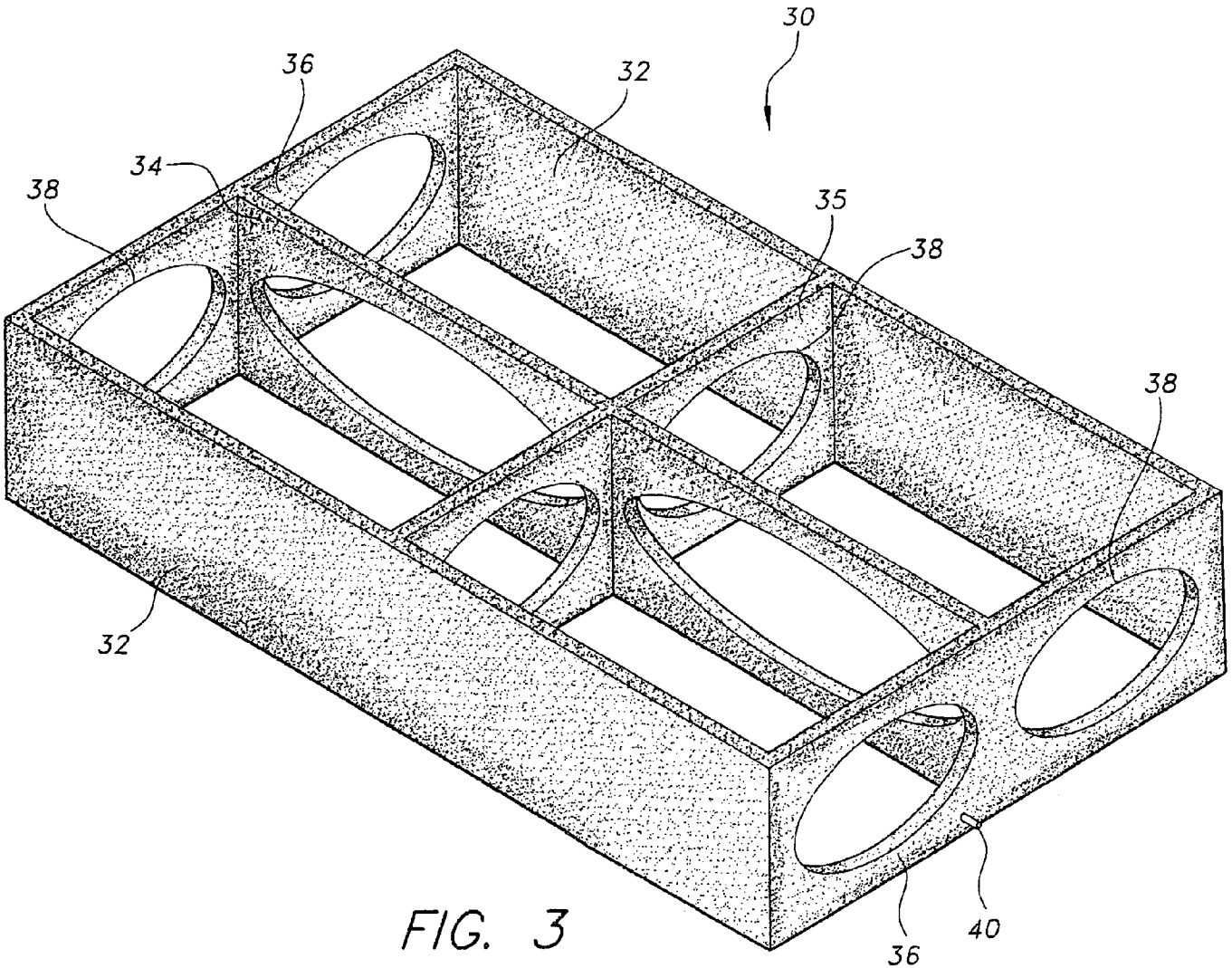
FIG. 3 is a perspective view of an inflatable interior frame.

FIG. 3 is a perspective view of the inflatable interior frame 30 removed from the outer inflatable structure 20. The inflatable interior frame 30 further comprises a pair of side walls 32, a center wall 34, a pair of end walls 36, a rib wall 35 and a plurality of air passages 38. The center wall 34 extends parallel to the side walls 32 and interconnects with the end walls 36 at opposite ends. The rib wall 35 extends parallel to end walls 36. interconnecting with the side walls 32 at opposite ends, and interconnects with the center wall 34 at a midpoint. The interior opening or valve 40 is located on the surface of one of the end walls 36 and is adapted to receive an air pump. The inflatable interior frame 30 is made from any inflatable material that is capable of providing the desired degree of rigidity. In preferred embodiments the interior frame 30 is made from materials including but not limited to nylon, vinyl, polyvinyl chloride (PVC). The interior frame 30 may also be made from rubber and plastic.

Air is pumped into the inflatable interior frame 30 using an air pump. Any common air pump may be used. Use of the inflatable frame allows for a smaller capacity air pump to be used. The inflatable device will also be inflated with much less effort and in much less time than the common inflatable device. The inflatable interior frame 30 is filled with air until it is rigid. The main air chamber 22 of the inflatable outer structure 20 does not need to be pumped with air. Because only the interior frame 30 is being inflated, it does not require as much effort or time to inflate the inflatable device 10.

The interior frame 30 is inflated by pumping air through the interior opening or valve 40. As the interior frame 30 becomes inflated and rigid the walls of the outer inflatable structure 20 separate and take shape. This allows for naturally drawn air to pass through the outer opening 50 into the main air chamber 22. The air passages 38 located on the interconnected ribs 36 and the center wall 34 allow the naturally drawn air to pass through the interior frame 30 and enter the entire main air chamber 22. Once the interior frame 30 is completely inflated it becomes rigid and supports the outer inflatable structure 20 without having to completely inflate the main air chamber 22. Once the interior frame 30 is inflated the outer opening 50 is covered with a common screw-on cap to trap the naturally drawn air inside of the main air chamber 22.

In certain embodiments of the present invention a higher degree of internal air pressure and firmness of the inflatable device is desired. In these embodiments an air valve is located on the cap of the outer opening 50. The air valve is adapted to receive the air pump used to inflate the interior frame 30. The air pump can then add additional air to the main air chamber 22 until the desired internal air pressure is achieved.

It is to be understood that the present invention is not limited to the embodiments described above, but encompasses any and all embodiments within the scope of the following claims.

We claim:

1. An inflatable device, comprising:

an inflatable interior frame having a pair of side walls, a pair of end wall interconnected to the side walls, a center wall extending parallel to the side walls and interconnecting with the end walls at opposite ends, and a rib wall extending parallel to the end walls and interconnecting with the side walls at opposite ends, said rib wall interconnecting with the center wall at a midpoint, each of said end walls, said rib wall, and said center wall having a pair of air passages defined therein;

a valve disposed in one of said end walls for receiving an air pump;

an outer inflatable structure substantially encasing said interior frame to define a main air chamber, said outer structure having an opening defined therein;

whereby, upon inflating the interior frame ambient air is drawn tbrnugh the opening of the outer structure into the main chamber and the interior frame become sufficiently rigid to support the outer structure.

2. The inflatable device of claim 1, wherein said inflatable interior frame is made of a material selected from the group consisting of PVC, vinyl, nylon, rubber and plastic.

3. The inflatable device of claim 1, wherein said outer inflatable structure has a generally rectangular shape.

4. The inflatable device of claim 1, wherein said plurality of air passages are elliptical in shape.

* * * * *